United States Patent [19]

Friis

[11] 4,305,629

[45] Dec. 15, 1981

[54] DRAWER ORGANIZER FOR KNIVES, FORKS, AND SPOONS

[76] Inventor: Edward Friis, 1013 Terrace Rd., Stuart, Fla. 33494

[21] Appl. No.: 151,124

[22] Filed: May 22, 1980

[51] Int. Cl.[3] ..... A47B 97/00; A47G 21/14

[52] U.S. Cl. ..... 312/204; 312/206; 248/37.3; 211/60 R; 206/565

[58] Field of Search ..... 312/206, 204, 313, 108, 312/107; 206/565; 211/60 R; 248/37.3, 37.6

[56] References Cited

U.S. PATENT DOCUMENTS

| | | | |
|---|---|---|---|
| 2,157,412 | 5/1939 | Hopkins | 248/37.6 |
| 2,249,851 | 7/1941 | Palliod et al. | 312/204 |
| 2,955,789 | 10/1960 | Smith | 248/37.3 |
| 3,366,232 | 1/1968 | Elfstrom et al. | 211/60 R |
| 3,513,593 | 5/1970 | Beck | 211/60 R |
| 3,580,394 | 5/1971 | Elliot | 248/37.6 |
| 4,082,386 | 4/1978 | Beasley, Jr. | 312/204 |
| 4,118,087 | 10/1978 | Dorf | 312/313 |
| 4,199,070 | 4/1980 | Magnussen, Jr. | 211/60 R |

FOREIGN PATENT DOCUMENTS

| | | | |
|---|---|---|---|
| 19867 | 3/1972 | Australia | 312/206 |

*Primary Examiner*—Victor N. Sakran
*Attorney, Agent, or Firm*—Carroll F. Palmer

[57] ABSTRACT

A drawer organizer for knives, forks and spoons, which can be adjustably mounted within any size drawer and positioned custom fitted at a desired location within the drawer. The organizer includes a plurality of individual mounting blocks which are positioned in a side by side array and joined to biased end members, allowing the entire array when biased to be adjustably positioned to any width drawer and at any location within the drawer. The organizer facilitates the removal and replacement of utensils.

5 Claims, 10 Drawing Figures

DRAWER ORGANIZER FOR KNIVES, FORKS, AND SPOONS

BACKGROUND OF THE INVENTION

This invention relates generally to a drawer organizer, and specifically to an easily installable, but removable divider assembly for separating spoons, forks and knives, within a drawer in a stacked organized array.

Many drawers have been made that have permanent sections or dividers within them into which are stacked knives, forks, spoons and other cooking utensils and tools. One of the problems with dividers is that the silverware or utensils within each partitioned area are not stacked but are randomly disposed. Each one also requires that a special partition be built into each wall. An example of a drawer organizer with knives, tools, and other utensils is shown in U.S. Pat. No. 4,082,386 which shows a complex pivotal platform into which utensils are stored. One drawback of such drawer assembly is that each pivotal section must be specially fitted for a particular drawer. Another drawback is that it does not provide for complete separation of all the utensils or tools such as knives, spoons and forks in one device. Another problem is the location of the device relative to the front of the drawer, in that it can not accommodate knives of different lengths.

The present invention overcomes the problems found in the prior art by providing a relatively non-complex organizer that will custom fit any drawer and which can be positioned relative to the front of the drawer in a desired location, thus providing for maximum organization of knives, spoons, and forks while ensuring that the knives are individually arranged in a safe position.

SUMMARY OF THE INVENTION

An organizer for knives, forks, spoons and other kitchen tools comprising a plurality of uniformly-formed, intermediary block members, each of said block members having a horizontal planar surface disposed near its vertical mid-section, and a raised vertical portion disposed at its center, each of said blocks having one or more vertical passages disposed along its lower edge from the front to rear of the block for receiving a knife blade. Each block has a protrusion along one side, and a recessed area along the opposite side, for interlocking with adjacent blocks in a side by side array. The horizontal surface of each block is higher in the front than the rear, the rear surface portion terminating in a lateral bead. A pair of end blocks, each of which has a spring-loaded plunger extending from one side, firmly retain the side-by-side block array between the side walls of the drawer.

The lateral width of a single block is sized relative to the plungers in the end blocks to allow a custom fit in any size drawer by adding intermediary blocks until the proper fit is achieved. Once the proper number of intermediary blocks has been selected, dependent on the lateral width of the drawer, the device may be installed in the drawer, where desired. Precise spacing from the front of the drawer can be used to accommodate cutlery, forks and spoons of particular lengths. The raised vertical portion of each block forms (between adjacent block members) a channel that receives the shaft of a fork or spoon or other kitchen tool; a plurality of channels are formed across the top of the device for multiple stacks of spoons and forks. The lower rear horizontal surface behind each channel supports the main body of each utensil. The front of each channel is contiguous with the front higher horizontal surface.

The front and rear base walls of each block includes one or more vertically disposed, knife-blade receiving slits aligned between front and rear that allow knives to be individually stored, vertically, within the drawer, simultaneously with forks and spoons resting in the upper channels.

Each of the intermediary blocks are identical in shape and can be uniformly formed from a single mold.

To install the device within a particular drawer, the appropriate number of blocks (plus the end blocks) are joined side-by-side to fit the inner lateral width of the drawer. The plungers on the end blocks are then depressed so that the array by its entirety is positioned in spring tension between the side walls of the drawer. The device is also positioned relative to the front wall of the drawer at a particular desired distance to accommodate knives or utensils of a particular length. The sum total of plunger extension length (combining the plunger lengths of each end block) is greater than the lateral width of an intermediary block. This insures a custom lateral fit.

It is an object of this invention to provide an improved organizer for a drawer for organizing spoons, forks, and knives, in a predetermined pattern within the drawer.

It is another object of this invention to provide a multi-purpose organizer that can be adapted to fit any size drawer and that is adjustable in position, once disposed within the drawer, for organizing knives, forks and spoons.

And yet still another object of this invention is to provide an organizer for knives, forks, and spoons which can be constructed from molded blocks of a single shape.

In accordance with these and other objects which will be apparent hereinafter, the instant invention will now be described with particular reference to the accompanying drawings.

PREFERRED EMBODIMENT OF THE INVENTION

Figure 1:
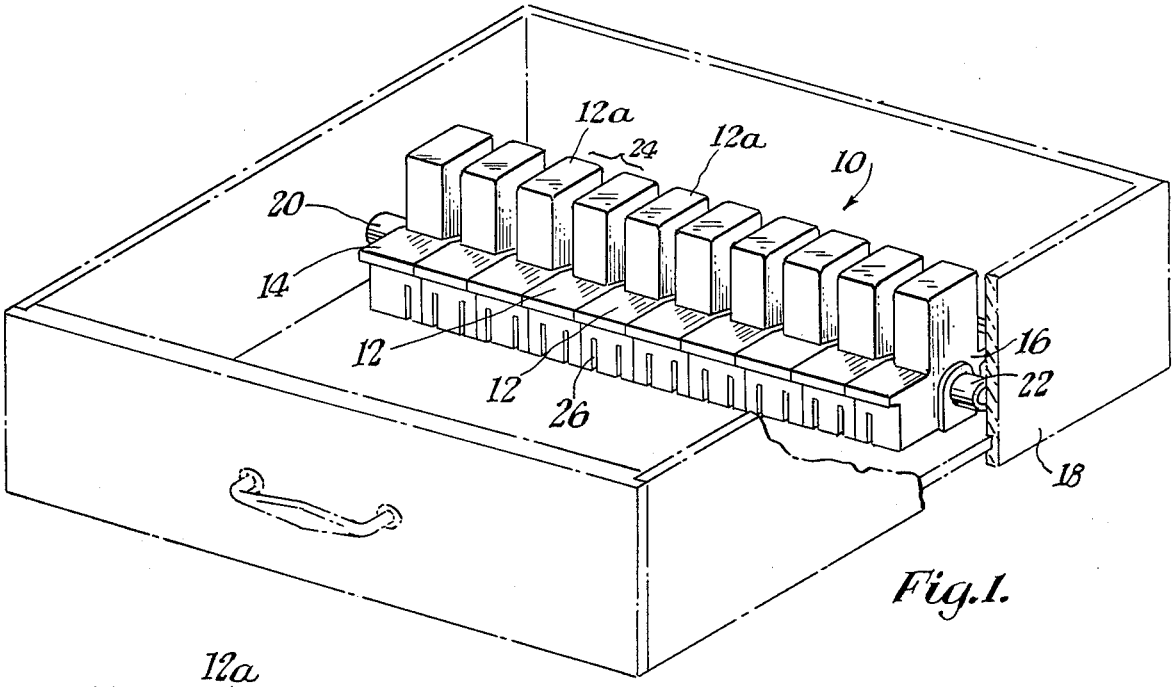
FIG. 1 shows a perspective view of the present invention as installed in a drawer shown in phantom.

Referring now to the drawings and specifically FIG. 1, the present invention is shown generally at 10 comprising a plurality of molded intermediary blocks 12 joined in a side by side array, with left and right end members 14 and 16 attached at each end, the entire device 10 being mounted within a drawer 18. The device 10 includes upper channels 24 which receive the shaft portions of stacked forks and spoons and lower vertical slits 26 which receive knife blades for safely disposing knives within the drawer at a lower vertical level than the spoons and forks.

Figure 2:
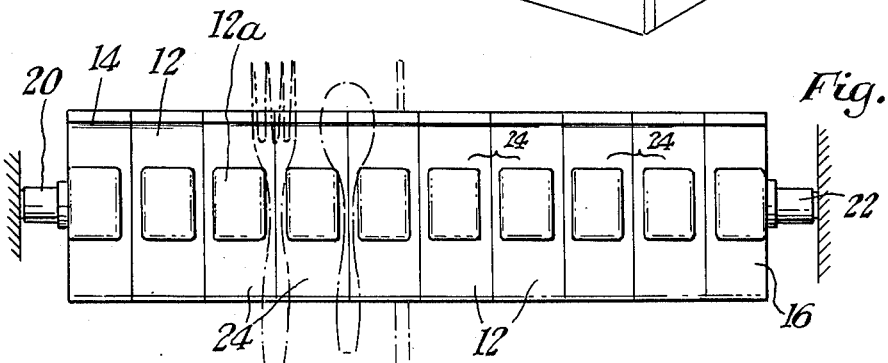
FIG. 2 shows a top plan view of the present invention with representative utensils shown in phantom.

FIG. 2 shows the upper channels 24 which are formed between raised vertical stems 12*a* of adjacent blocks 12. The left and right end blocks, 14 and 16 respectively, include spring mounted plungers 20 and 22 respectively which can be compressed inwardly at each end to firmly hold the intermediate blocks 12 in a side by side array within the drawer under spring tension. A representative fork, spoon and knife are shown dotted.

Figure 3:
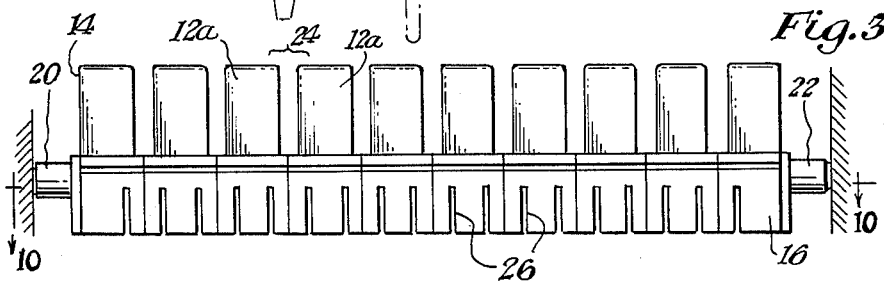
FIG. 3 shows a front elevational view of the present invention.

FIG. 3 shows a front view of the device and the upper channels 24 and their vertical relationship to the knife slits 26 disposed along the front and rear base walls of each block. Each front slit 26 has a corresponding rear slit 26 aligned along a flat plane. Thus it is readily apparent that spoons and forks can be quickly and conveniently added to or removed from the organizer without interfering with the knives that are positioned safely below the area where the spoons and forks are stacked. Likewise knives disposed in vertical slits 26 (which form passages through each block) can also be removed without disturbing the forks or spoons mounted above.

Figure 4:
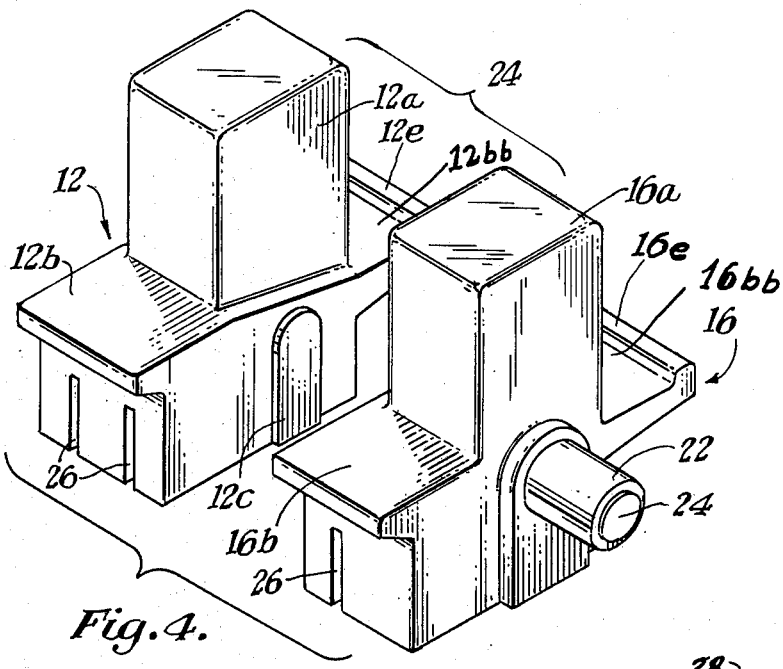
FIG. 4 shows a perspective view of one intermediary block and the right end block, exploded.

FIG. 4 shows one of the intermediary blocks 12 having a raised vertical stem 12*a*, a horizontal surface portion 12*b*, a side protrusion 12*c*, an opposite side recess 12*d* and a rear bead portion 12*e*. The side recess 12*d* is shaped to envelope the side protrusion 12*c*. The intermediary blocks 12 of the array are identical in shape to each other. Each protrusion 12*c* interlocks with each recess 12*d* of an adjacent block. The right end block 16 as shown includes raised vertical stem 16*a*, horizontal surface portion 16*b*, side recess 16*d*, rear bead portion 16*e* and a plunger 22 mounted through a side opening.

Figure 5:
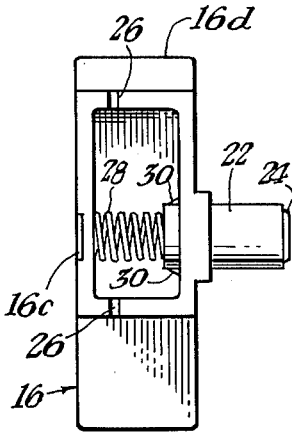
FIG. 5 shows a bottom plan view of the right end block used with the present invention.
Figure 8:
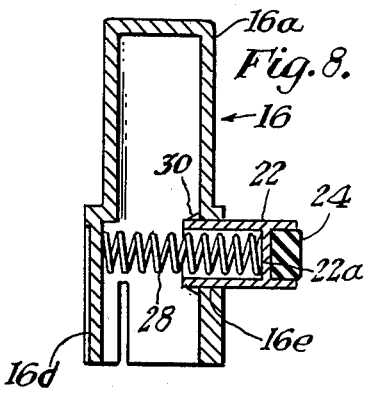
FIG. 8 shows a front elevational view in cross-section of the right end block including the plunger.

FIGS. 5 and 8 show how the plunger 22 operates in the right end block 16. The plunger 22 has a hollow mid-section for receiving a portion of spring 28, mounted through an opening in the side wall right end of block 16 and is reciprocally moveable therein. An inner wall 22*a* inside plunger 22 engages the end of spring 28 and convex shaped rubber insert 24. Stops 30 prevent the plunger 22 from being separated from block 16. The plunger 22 is depressed during the installation, positioning, or removal of the array in a drawer. The spring tension inwardly from each plunger in conjunction with the intermediary block interlocked protrusions and recesses firmly hold the device in any drawer. The entire array may be spaced from the front or back of the drawer as desired to accommodate knives or other utensils of a desired shape and length for the maximum convenience and access to the knives, forks, spoons or other tools used in the kitchen.

Figure 6:
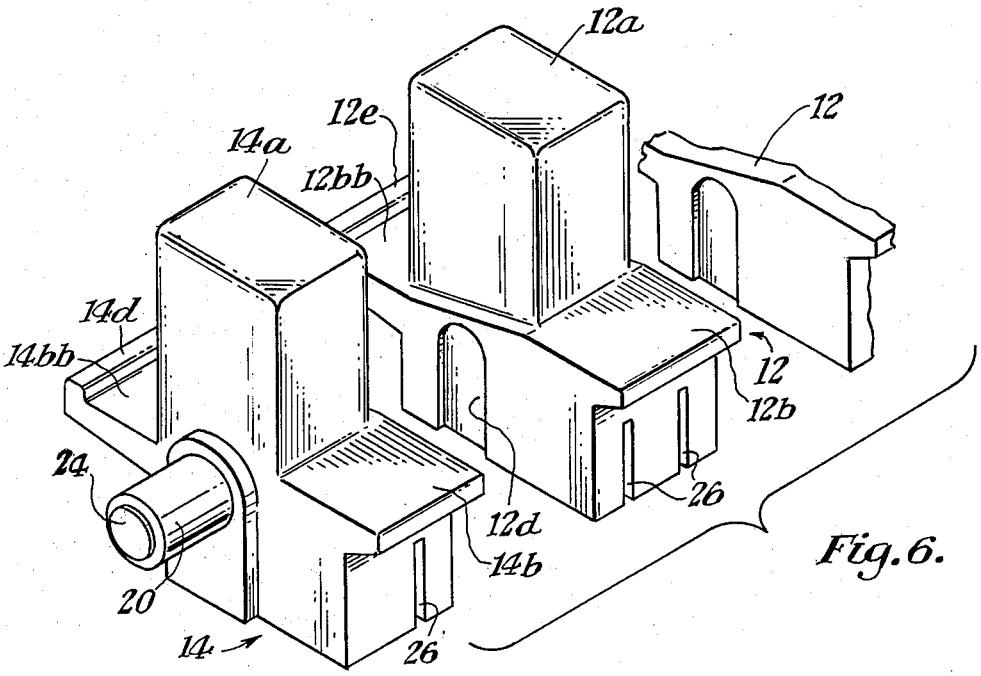
FIG. 6 shows a perspective partially fragmentary view of an intermediary block and the left end block, exploded.

FIG. 6 shows the left end block 14 and an intermediary block 12. The left end block 14 is a mirror image of right end block 16 with the exception of the side protrusion 14*c* and recess 16*c* (FIG. 10) on end block 16. The left end block 14 includes a plunger 20 which is used to tension the array from the left side. Adjacent intermediary block 12 shows a recess 12*d* which is sized in depth and shape to receive the protrusion 14*c* shown in FIG. 10. Also it should be noted that front horizontal surface areas 12*b* (and the end block horizontal surface areas 14*b* and 16*b*) are higher than the rear horizontal areas 12*bb*, 14*bb*, and 16*bb*. This is to accommodate the body depth of the spoons, forks, and knives for stacking in a stable configuration.

Figure 7:
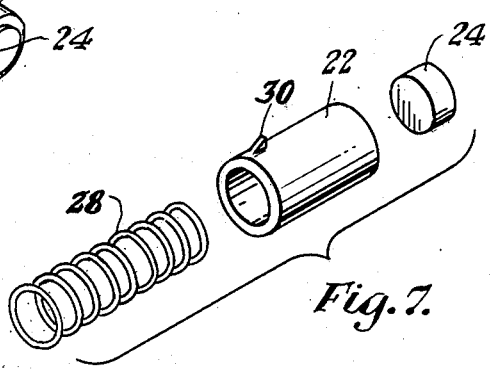
FIG. 7 shows an exploded, perspective view of the spring-loaded plunger used with the present invention.
Figure 9:
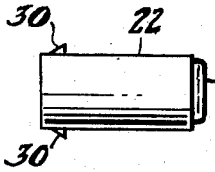
FIG. 9 shows a top plan view of the plunger utilized in the present invention.

FIGS. 7, 8, and 9 show the plunger as utilized in a right end block 16. The spring 28 fits within the hollow portion of plunger 20, with one end of spring 28 engaging wall 22*a* which also acts as a stop for a rubber insert 24 at the end of plunger 20. Stops 30 prevent the plunger from being removed from the block. One important aspect of the invention is that the depressable distance of plungers 20 and 22 along their longitudinal axes exceed the lateral width of a single intermediary block member such that a custom fit in any width drawer can be achieved.

Figure 10:
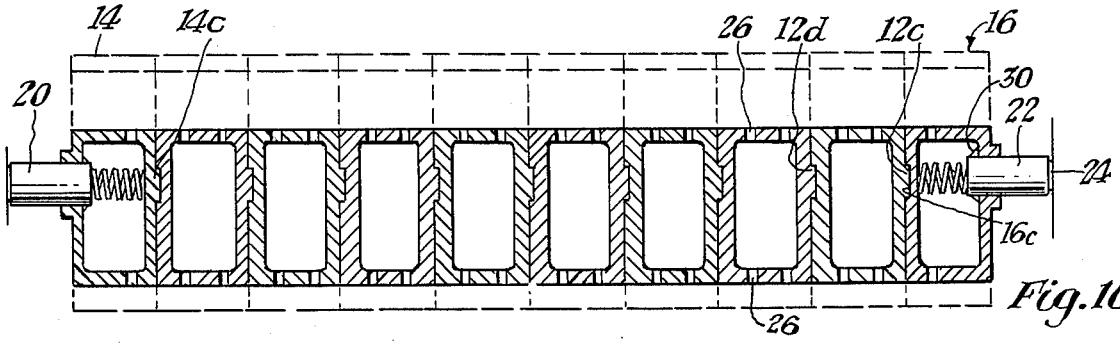
FIG. 10 shows a top plan cross-sectional view through line 10—10 of FIG. 3.

FIG. 10 shows how the intermediary and end blocks interlock in a side-by-side array.

By forming the intermediary blocks 12 as shown above, the production costs of the entire unit can be greatly reduced by mass production using a single mold. The invention further provides for maximum utilization of space within the drawer by providing upper sections that house the forks, spoons and other desired tools while at the same time utilizing the lower section for storage of the knives, thus using the full extent of vertical space within the drawer.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An organizer for kitchen utensils such as knives, forks, and spoons or like utensils mountable in a drawer which comprises:

a plurality of separate, molded intermediary block members that are of substantially equal width and are interlockable in contact with one another in a side-by-side array, a left end block member, a right end block member, said left end and right end block members being interlockable with said intermediary block members to form left and right ends on said side-by-side array, tensioning means carried by both said left end and right end block members that extend outboard of the left and right ends of said side-by-side array, slits in the underside of said block members for receiving knife blades, and channels on the upper side of said side-by-side array formed between vertical stems that extend upwardly from each said block members for receiving spoons and forks.

2. An organizer of claim 1 wherein said intermediary block members include a tongue portion on one side and a groove portion on the opposite side, one of said end block members includes a tongue portion and the other end block member includes a groove portion, said tongue and groove portions being the means for interlocking said block members into said side-by-side array.

3. An organizer of claim 1 wherein said tensioning means comprises plungers that are spring biased outwardly of the outboard sides of said end block members, the combined fully extended distance of said plungers beyond said outboard sides being greater than the width of one of said intermediary blocks, whereby said array may be adaptable to any width drawer by selection of the number of intermediary block members in the array.

4. An organizer of claim 3 wherein said plungers have resilient elements on their outboard ends.

5. An organizer of claim 1 wherein said intermediary block members have a pair of said knife receiving slits and said end block members each have a single knife receiving slit.

* * * * *